US005769665A

United States Patent [19]

Neely et al.

[11] Patent Number: 5,769,665

[45] Date of Patent: Jun. 23, 1998

[54] BACKSHELL ADAPTER CABLE CONNECTION ASSEMBLY AND METHOD FOR GROUNDING BRAIDED CABLE SHEATHINGS

[76] Inventors: Nick Neely, 260 Peak Dr., Alpharetta, Ga. 30202; Joseph M. Reilly, 7620 E. Osie, Wichita, Kans. 67207

[21] Appl. No.: 786,224

[22] Filed: Jan. 21, 1997

[51] Int. Cl.[6] ..... H01R 9/03

[52] U.S. Cl. ..... 439/610

[58] Field of Search ..... 439/610, 98, 99, 439/578

[56] References Cited

U.S. PATENT DOCUMENTS 5,052,947 10/1991 Brodie et al. ..... 439/610
5,174,769 12/1992 Dearman ..... 439/98

*Primary Examiner*—Gary F. Paumen
*Attorney, Agent, or Firm*—Kenneth H. Jack

[57] ABSTRACT

A connector backshell adapter having an annular spring receiving channel, having a plurality of fly lead receiving apertures within the spring receiving channel, and having a backshell adapter attaching means; a plurality of electrically conductive fly leads, the fly leads having a metal braid sheathing attaching means at one end and a hook at the other end, the hooks being positioned to pass through the fly lead receiving apertures to overlie the floor of the spring receiving channel; and a spring means in the form of a spiral spring metal coil arranged to lie within the spring receiving channel, the spiral coil being wrapped around the floor of the spring receiving channel providing a compressive force pressing the fly leads against the floor of the spring receiving channel, securing and electrically connecting the fly leads to the connector backshell adapter.

9 Claims, 4 Drawing Sheets

BACKSHELL ADAPTER CABLE CONNECTION ASSEMBLY AND METHOD FOR GROUNDING BRAIDED CABLE SHEATHINGS

FIELD OF THE INVENTION

The present invention relates to an improved connector backshell adapter, cable connection assembly, and method for utilizing the improved connector backshell adapter to receive, secure, and electrically ground electrical cables and lead wires having braided metal sheathings.

DESCRIPTION OF THE PRIOR ART

U.S. Pat. No. 1,073,596 issued Sep. 23, 1913, to Egerton discloses an electric cable sheathing connecting mechanism.

U.S. Pat. No. 2,472,986 issued Jun. 14, 1949, to Reder discloses a core protector and strain reliever for use with electrical connectors.

U.S. Pat. No. 3,564,117 issued Feb. 16, 1971, to Scheffler, et al., discloses a cable splicing construction.

U.S. Pat. No. 4,053,200 issued Oct. 11, 1977, to Pugner discloses a co-axial cable connector device.

U.S. Pat. No. 4,629,275 issued Dec. 16, 1986, to Maul discloses a strain relief adapter for electrical connection of braid shielded cables.

U.S. Pat. No. 4,808,121 issued Feb. 28, 1989, to Smreakar discloses an electrical connector assembly for attaching braid shielded cables.

U.S. Pat. No. 4,902,248 issued Feb. 20, 1990, to Robertson discloses a cable connection assembly for securely affixing braided cable sheathing to the outer periphery of an electrical backshell adapter.

None of the above disclosed U.S. Patents teach or describe the novel, inventive and unique aspects and attributes of the present invention.

SUMMARY OF THE INVENTION

Modern electronic equipment and components commonly operate upon very small inputs of electrical power. Such equipment commonly is sensitive to and is affected by small electrical current fluctuations from lead wires and cables leading to and from the equipment. A common cause of small voltage and amperage fluctuations occurring in electronic component lead wires is the presence of electromagnetic flux. Where an electrically conductive wire is exposed to radiowaves or passes through a magnetic field, an electric current in the wire is induced. Such induced electrical currents commonly are small in magnitude, but may be great enough to interfere with the function and operation of an electronic component to which the lead wire is attached. In order to solve the problem of induced electric currents in electronic component lead wires, it has become common practice to provide a braided metal sheathing encasing the lead wires and shielding the lead wires from electromagnetic flux.

It is desirable that braided metal sheathing covering an electronic component lead wire be electrically grounded near the point of entry of the lead wire into the component. Without such grounding, the metal sheathing itself may introduce extraneous electrical signals into the component. Also, without grounding, accidental applications of electric current to the metal sheathing may cause the wires it encases to burn or short.

A known method of grounding braided metal lead wire sheathings is to solder a fly lead wire to an end of the metal braid, and to attach the opposite end of the fly lead to an exterior metallic structural member near the entry port of the lead wires. This method often is undesirable because it is often necessary to seal the entry port of the lead wire into the electronic component with a plastic heat shrinkable sleeve. Branched extension of fly leads away from electronic component lead wires near their entry ports interferes with installation of heat shrinkable plastic sleeves. Fly leads which are so installed are also easily subject to damage or accidental disconnection.

Another method of grounding braided metal lead wire sheathings is to attach a fly lead to the braid and to extend the fly lead through the entry port of the electronic component box along with the lead wires; the terminal end of the fly lead being grounded upon some metallic structural member in the interior space of the electronic component. A problem created by this method arises from the fact that any electrical current from the braided metal sheathing will pass through the fly lead within the electronic component box, generating electromagnetic flux at its terminal end. Thus, the grounding of fly leads within an electronic component box may result in undesirable radio interference within the component. Attachment and detachment of fly leads is also difficult to accomplish where the fly leads are internally grounded.

The present invention solves the above problems by providing an improved connector backshell adapter, a cable connection assembly, and method for grounding braided cable sheathings without branching a lead wire to connect to the exterior of an electronic component, and without extending a lead wire into the interior space of the electronic component.

In particular, a cylindrical connector backshell adapter having a hollow interior bore is provided. The first end of the connector backshell adapter is threaded, allowing the adapter to be fixedly attached to a threaded aperture or lead wire port in an electronic component box. The body portion of the connector backshell adapter has an annular channel within its outer radial surface, and the body portion has a plurality of oblong fly lead receiving apertures extending from the interior bore of the connector backshell adapter to the floor of the channel.

In use, the connector backshell adapter is fixedly attached to an aperture or lead wire port in an electronic component box by rotating the adapter so that its threads engage matching threads which annularly surround the aperture. Metal braid shielded cables or lead wires which are to be extended into the electronic component through the attached connector backshell adapter are then stripped of their braided shielding exposing a sufficient length of unshielded lead wire to extend into the electronic component. The ends of the metal braid shielding are then pulled away from the underlying cable. Electrically conductive insulated fly lead wires are then soldered to the ends of the braids, preferably utilizing solder sleeves. The opposite ends of the fly leads are then extended into the interior bore of the backshell adapter, and guided to pass through one of the fly lead receiving apertures. The ends of the fly leads are then pulled outwardly through the fly lead receiving aperture, pulling the solder sleeves and the exposed ends of the metal braid shields into close proximity with the outer opening of the connector backshell adapter. The fly leads are then bent so that they form a hook or a "U" extending from the bore of the connector backshell adapter, and through a fly lead receiving aperture to overlie the floor of the spring receiving channel.

A steel spring leaf coil is then wrapped around the outer body of the connector backshell adapter within the fly lead receiving channel, the coil pressing against the fly leads and holding them securely in place; thereby, electrically grounding the braided metal shielding and the fly leads to the connector backshell adapter and to the electronic component box. The floor of the spring receiving channel and its sidewalls preferably are knurled to provide enhanced friction between the fly leads and the connector backshell adapter.

After installation of the spring steel coil, excess fly lead material protruding therefrom may be trimmed and cut away. Thereafter, a heat shrinkable plastic boot may be passed over the lead wires and over the connector backshell adapter, and shrunk to seal the adapter at its outer opening.

Accordingly, the primary object of the present invention is to provide an improved connector backshell adapter, cable connection assembly, and method for electrically grounding braided metal cable sheathings without extension of fly leads from such sheathings into the interior space of an electronic component box.

It is a further object of the present invention to provide an improved connector backshell adapter, cable connection assembly, and method for grounding braided cable sheathings without electrical grounding fly leads through branched extension to attachment points external to an electronic component box.

It is a further object of the present invention to provide a connector backshell adapter, cable connection assembly, and method for electrically grounding braided metal sheathings which is economical, and allows for easy installation and removal of fly leads.

Other and further advantages and benefits of the present invention shall become apparent upon reading and review of the detailed description below and of the appended drawings.

BRIEF DESCRIPTION OF THE DRAWINGS

The present invention will now be described in greater detail by way of examples with reference to the accompanying drawings, wherein.

DESCRIPTION OF THE PREFERRED EMBODIMENT

Figure 1:
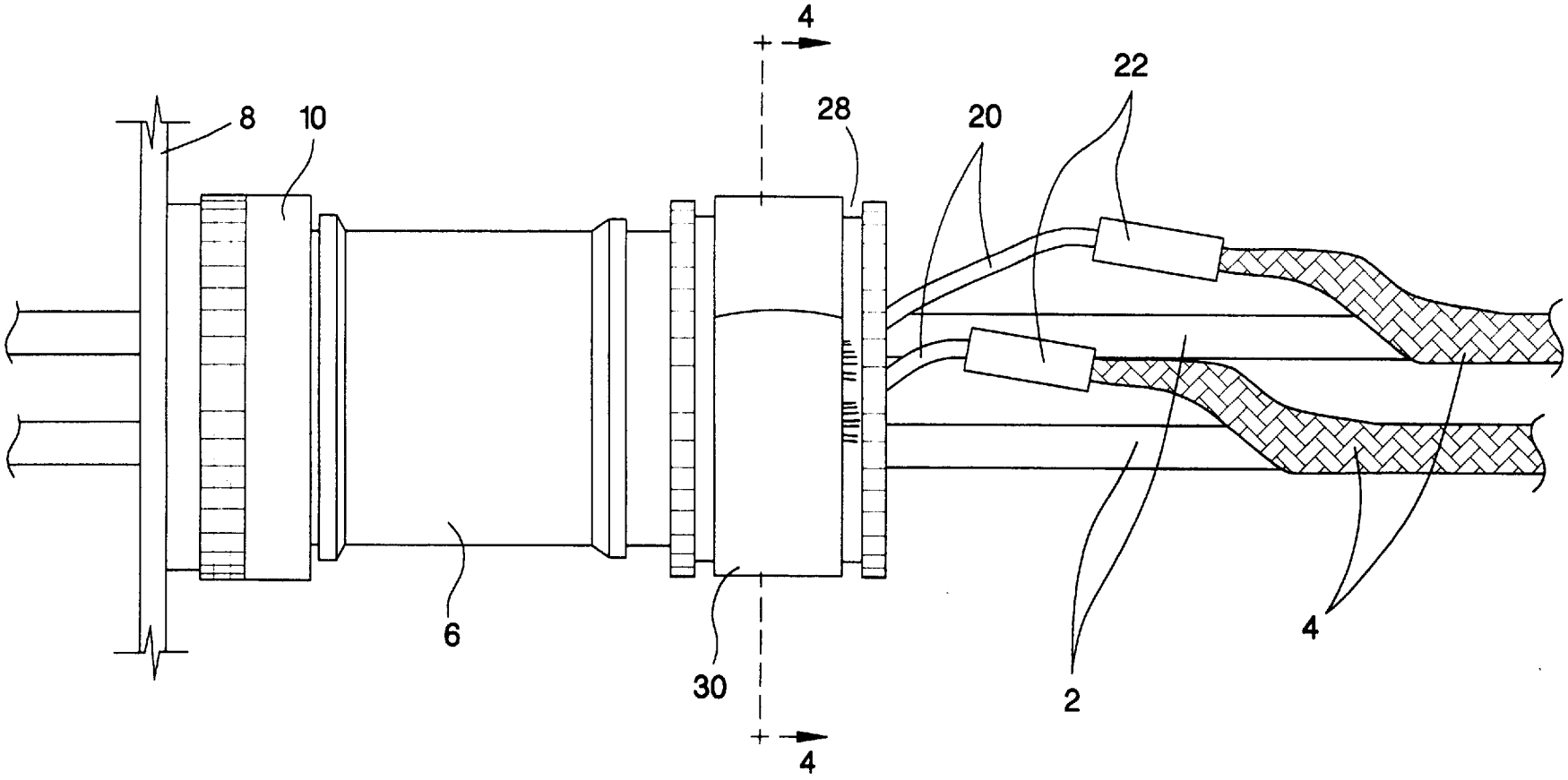
FIG. 1 is a sideview of the connector backshell adapter and cable connection assembly of the present invention.

Referring to FIG. 1, electronic lead wires 2 having braided metal sheathings 4, the sheathings typically being composed of copper or aluminum, extend through a connector backshell adapter 6 and through the wall 8 of an electronic component housing to enter the electronic component.

Figure 3:
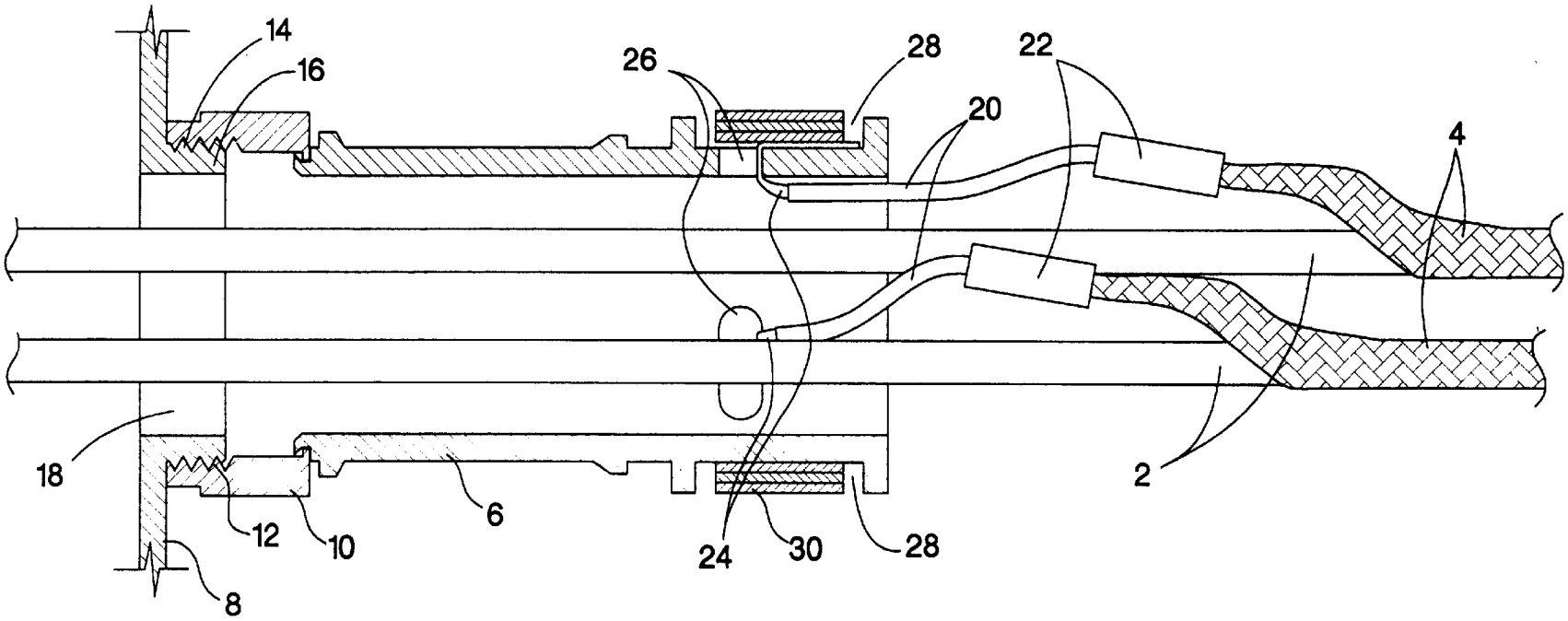
FIG. 3 is a longitudinal cutaway view of FIG. 1.

Referring to FIG. 3, the connector backshell adapter 6 has a rotatable coupling nut 10 rotatably attached thereto. The coupling nut 10 has spiral threads 12, which are closely fitted for engagement with spiral threads 14 upon an annular collar 16 surrounding a lead wire port 18 through the electronic component housing wall 8.

Further referring to FIG. 3, insulated fly lead wires 20 are fixedly attached to the ends of the braided metal sheathings 4 by means of solder sleeves 22. The ends of the fly leads 20 are stripped, exposing their metal cores 24, and the metal cores 24 are extended through fly lead receiving apertures 26 to lie upon the floor of an exterior annular spring receiving channel 28.

Figure 2:
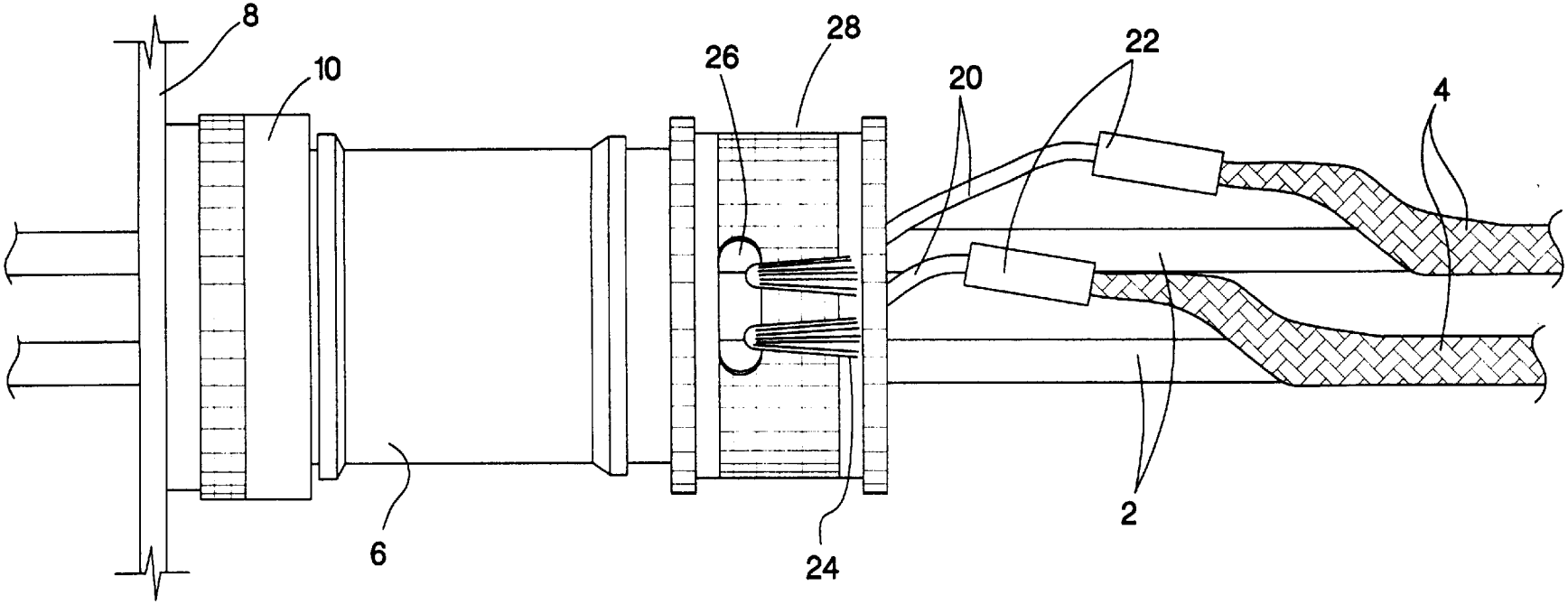
FIG. 2 represents the same view as FIG. 1 with steel coil spring removed.

Referring to FIG. 2, a plurality of metal cores 24 of the insulated fly leads 20 may be guided to pass through and protrude from a single fly lead receiving aperture 26, allowing a length of the metal cores 24 to rest upon the knurled floor of the spring receiving channel 28.

Figure 4:
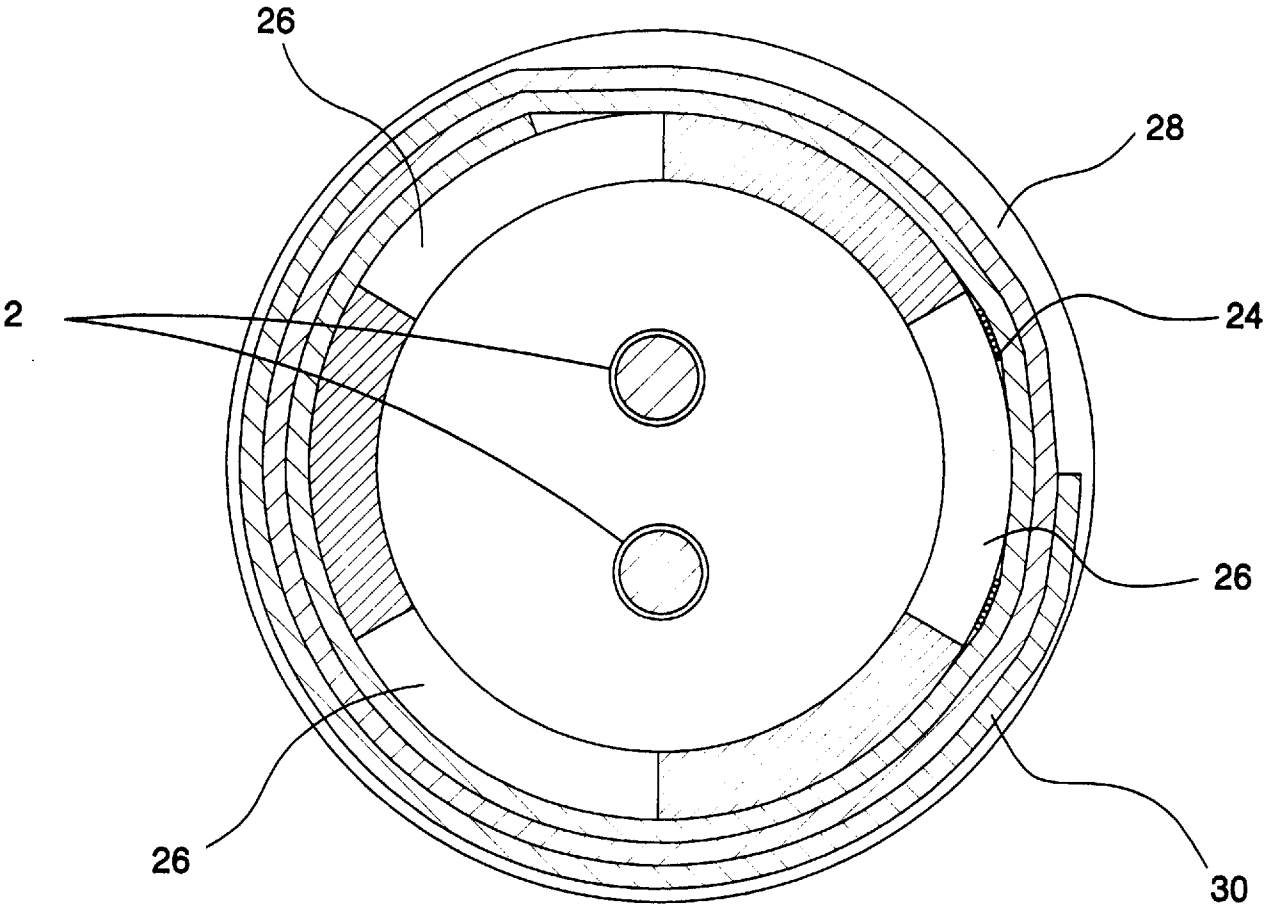
FIG. 4 is a transverse cutaway view of the connector backshell adapter and cable connection assembly.

Referring to FIG. 4, an inner coiled spring 30 preferably composed of an open ended band of spring steel is wrapped around the body portion 6 of the connector backshell adapter to lie within the spring receiving channel 28. The spring 30 applies an inwardly directed compression force upon the metal cores 24 of the insulated fly leads 20. The compression force of the spring 30 upon the metal cores 24 against the floor of the spring receiving channel 28 securely affixes the fly leads to the backshell adapter and electrically connects and grounds the fly leads and the braided metal cable sheathing to the backshell adapter.

Referring simultaneously to FIGS. 2 and 4, the spring receiving apertures 26 preferably are oblong, having their long midline axes parallel to the sidewalls of the spring receiving channel 28. The oblong configuration of the spring receiving apertures 26 allows fly leads having metal cores of different thicknesses to be inserted into a single fly lead receiving aperture, each receiving an adequate inwardly directed compressive force from the steel spring coil 30. Referring to FIG. 4, the steel spring coil 30 has sufficient flexibility to slope between and compress a plurality of fly lead metal cores 24 having differing thicknesses.

In use, the improved connector backshell adapter, cable connection assembly, and method of the present invention may be economically and conveniently used for grounding six or more metal braid shielded cables. For example, referring to FIG. 4, the connector backshell adapter may have three fly lead receiving apertures 26, each configured as an oblong slot. One, two, or three fly leads may pass through each aperture, and be securely held and grounded by a single spring coil 30. The fly leads may be conveniently attached and detached by manually wrapping and unwrapping the spring coil 30. The spring coil 30 may be economically used and reused.

Referring to FIG. 3, it can be seen that the fly leads 20 could alternately pass completely through the bore of the connector backshell adapter, to pass through the lead wire port 18 in the sidewall 8 of the electronic component. Such fly leads could then be fixedly attached and electrically grounded at some point on the interior of the component. Such alternate method is undesirable, due to difficulty of attaching and detaching the fly leads at a point on the interior of the electronic component. Said alternate method is also undesirable because grounding fly leads extending into an electronic component may introduce undesirable radiowave interference into the electronic component.

The cable connection assembly portrayed at FIG. 3 is readily adapted for receiving a cylindrical plastic heat shrinkable sleeve or boot by passing the sleeve over the juncture of the connector backshell 6 and the fly leads 20. Upon application of heat to a heat shrinkable sleeve so positioned, the outer opening of the connector backshell adapter may be sealed. Referring to FIG. 3, it can be seen that an alternate method of grounding the fly leads 20 is to route the fly leads 20 to pass over the exterior walls of the connector backshell adapter 6 for fixed attachment and electrical connection at some point on the exterior surface of the electronic component wall 8. Such branched attachment and grounding fly leads is undesirable because exterior exposure of the fly leads subjects them to accidental damage or disconnection. Such method of attachment and grounding is also undesirable because branching of the fly leads to some point on the exterior of a component box interferes with utilization of heat shrinkable sleeves.

The improved connector backshell adapter, cable connection assembly, and method for grounding braided cable sheathings disclosed above solves the problems presented by interior attachment and grounding of sheathings, and exterior branched attachment and grounding of sheathings, while providing an economical and convenient method for attachment and detachment of fly leads.

It will be apparent to those skilled in the art having due regard to this disclosure that other modifications of this invention beyond those embodiments specifically described herein may be made without departing from the spirit of the invention. Accordingly, such modifications are considered within the scope of the invention as limited solely by the appended claims.

We claim:

1. A cable connection assembly for electrical grounding of a plurality of braided cable sheathings comprising:

(A) A connector backshell adapter having a first end and a second end, having a hollow interior bore extending therethrough from the first end to the second end, having an annular, outwardly opening, spring receiving channel within the connector backshell adapter's outer peripheral surface, the spring receiving channel having a floor and a pair of sidewalls, and having a plurality of fly lead receiving apertures extending from the interior surface of the bore of the connector backshell adapter to the floor of the spring receiving channel, the first end of the connector backshell adapter comprising a backshell adapter attaching means for fixedly attaching the connector backshell adapter to a solid apertured surface;

(B) A plurality of electrically conductive fly leads, each fly lead having a first end and a second end, the first end of each fly lead forming a hook, and the second end of each fly lead having fixedly attached thereto a braid attaching means for fixedly attaching and electrically connecting the fly lead to a braided metal cable sheathing, the hooks being positioned within the bore of the connector backshell adapter, within the fly lead receiving apertures and within the spring receiving channel so that the first ends of the fly leads extend through the bore of the connector backshell adapter, thence through a fly lead receiving aperture, and thence to a position overlying the floor of the spring receiving channel; and (C) A spring means in the form of a coil arranged to lie within the spring receiving channel and to be wrapped around the floor of the spring receiving channel, the coil including a resilient ribbon arranged to be wrapped around the floor of the spring receiving channel in a plurality of overlapping turns, the coil providing a compressive force between the interior surface of the coil and the floor of the spring receiving channel, the compressive force pressing the first ends of the fly leads against the floor of the spring receiving channel, securing and electrically connecting the fly leads to the connector backshell adapter.

2. The cable connection assembly of claim 1 wherein the fly lead receiving apertures are oblong slots the long midline axes of which are substantially parallel with the sidewalls of the spring receiving channel.

3. The cable connection assembly of claim 1 wherein the floor of the spring receiving channel is knurled.

4. The cable connection assembly of claim 1 wherein the backshell adapter attaching means comprises spiral threads closely fitted for attachment to the solid apertured surface, the apertures of which having spiral threads.

5. The cable connection assembly of claim 1 wherein the fly lead receiving apertures are oblong slots the long midline axes of which are substantially parallel to the sidewalls of the spring receiving channel, wherein the floor of the spring receiving channel is knurled, and wherein the backshell attaching means comprises spiral threads closely fitted for attachment to the solid apertured surface, the aperture of which having spiral threads.

6. The cable connection assembly of claim 5 wherein the braid attaching means comprises a plurality of solder sleeves.

7. The cable connection assembly of claim 1 wherein the spring means comprises an open-ended ribbon of spring steel.

8. A method for electrically grounding a plurality of braided metal cable sheathings comprising the steps of:

(A) fixedly attaching and electrically connecting the ends of a plurality of electrically conductive fly leads to the ends of the braided metal cable sheathings; (B) extending the opposite ends of the fly leads into the interior bore of a connector backshell adapter, the connector backshell adapter having an annular outwardly opening spring receiving channel within its outer peripheral surface, the spring receiving channel having a floor and a pair of sidewalls, and the connector backshell adapter having a plurality of fly lead receiving apertures extending from the interior surface of the bore of the backshell adapter to the floor of the spring receiving channel;

(C) further extending said ends of the fly leads through the plurality of fly lead receiving apertures of the connector backshell adapter to protrude outwardly from the floor of the spring receiving channel;

(D) bending the fly leads so that portions thereof overlie the floor of the spring receiving channel; and (E) wrapping a spring metal within the spring receiving channel and in a plurality of overwrapping turns over the floor of the spring receiving channel causing the spring to provide a compressive force between the interior surface of the spring and the floor of spring receiving channel, pressing the fly leads against the floor of the spring receiving channel, securing and electrically connecting the fly leads and the braided metal cable sheathing to the connector backshell adapter.

9. The method of claim 8 wherein the step of fixedly attaching the fly leads to the braided metal cable sheathings comprises the steps of installing solder sleeves over the fly leads and the braided metal sheathings at their junctures and heating the solder sleeves.

* * * * *